US008824117B2

(12) United States Patent
Zhang et al.

(10) Patent No.: US 8,824,117 B2
(45) Date of Patent: Sep. 2, 2014

(54) RELAY AND METHOD FOR CONTROLLING RELAY

(75) Inventors: Ju-Yuan Zhang, Shenzhen (CN); Bi-Qing Luo, Shenzhen (CN); Xin Lu, Shenzhen (CN); Shih-Fang Wong, New Taipei (TW)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 253 days.

(21) Appl. No.: 13/330,531

(22) Filed: Dec. 19, 2011

(65) Prior Publication Data

US 2013/0107414 A1 May 2, 2013

(30) Foreign Application Priority Data

Oct. 31, 2011 (CN) ..... 2011 1 0337188

(51) Int. Cl.

| | |
|---|---|
| ***H01H 47/00*** | (2006.01) |
| ***H01H 9/00*** | (2006.01) |
| ***H01H 51/22*** | (2006.01) |
| ***H01H 51/30*** | (2006.01) |

(52) U.S. Cl.
USPC ..... 361/210; 361/160

(58) Field of Classification Search
USPC ..... 361/166, 167, 210, 160, 206
See application file for complete search history.

(56) References Cited

U.S. PATENT DOCUMENTS

| | | | | |
|---|---|---|---|---|
| 4,600,966 | A * | 7/1986 | Mueller et al. | 361/166 |
| 6,246,564 | B1 * | 6/2001 | Sugiura et al. | 361/166 |
| 7,706,118 | B2 * | 4/2010 | Yang | 361/160 |
| 2002/0029765 | A1 * | 3/2002 | Giavi et al. | 123/490 |

FOREIGN PATENT DOCUMENTS

JP 2005045597 A * 2/2005 ..... H04B 1/74

* cited by examiner

*Primary Examiner* — Rexford Barnie
*Assistant Examiner* — Christopher Clark
(74) *Attorney, Agent, or Firm* — Novak Druce Connolly Bove + Quigg LLP

(57) ABSTRACT

A method for controlling a normally closed relay includes: providing power to at least one of a first electromagnet and a second electromagnet via a power input port, then cause a first actuation member and a second actuation member to separate from each other, and the relay is then in an open state; and stopping providing power to the at lease one first electromagnet and the second electromagnet which being powered by the power input port such that the first actuation member and the second actuation member makes contact with each other, and the relay is then in a closed state.

11 Claims, 6 Drawing Sheets

RELAY AND METHOD FOR CONTROLLING RELAY

BACKGROUND

1. Technical Field

The present disclosure relates to relays.

2. Description of Related Art

Generally, a relay may include a movable contact, a stationary contact, a coil, an iron core inside the coil, a transistor, and a power source. Usually, the movable contact is electrically connected to the power source, and the stationary contact is connected to an output terminal of the relay. One end of the coil is connected to the power source, and the other end of the coil is connected to a collector of the transistor, an emitter of the transistor is grounded. The transistor is turned on when a control voltage is applied to a base of the transistor, to cause a current through the coil, and the coil produces an electromagnetic field accordingly. The iron core thus attracts the movable contact and causes the movable contact to make contact with the stationary contact, and then the relay can output a voltage. However, in such a relay, if the relay needs to output voltage for a long time, the control voltage must constantly be applied to the base of the transistor, thus resulting an excess of power consumption.

Therefore, it is desirable to provide a relay to overcome the described limitations.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will be described in detail, with reference to the accompanying drawings.

Figure 1:
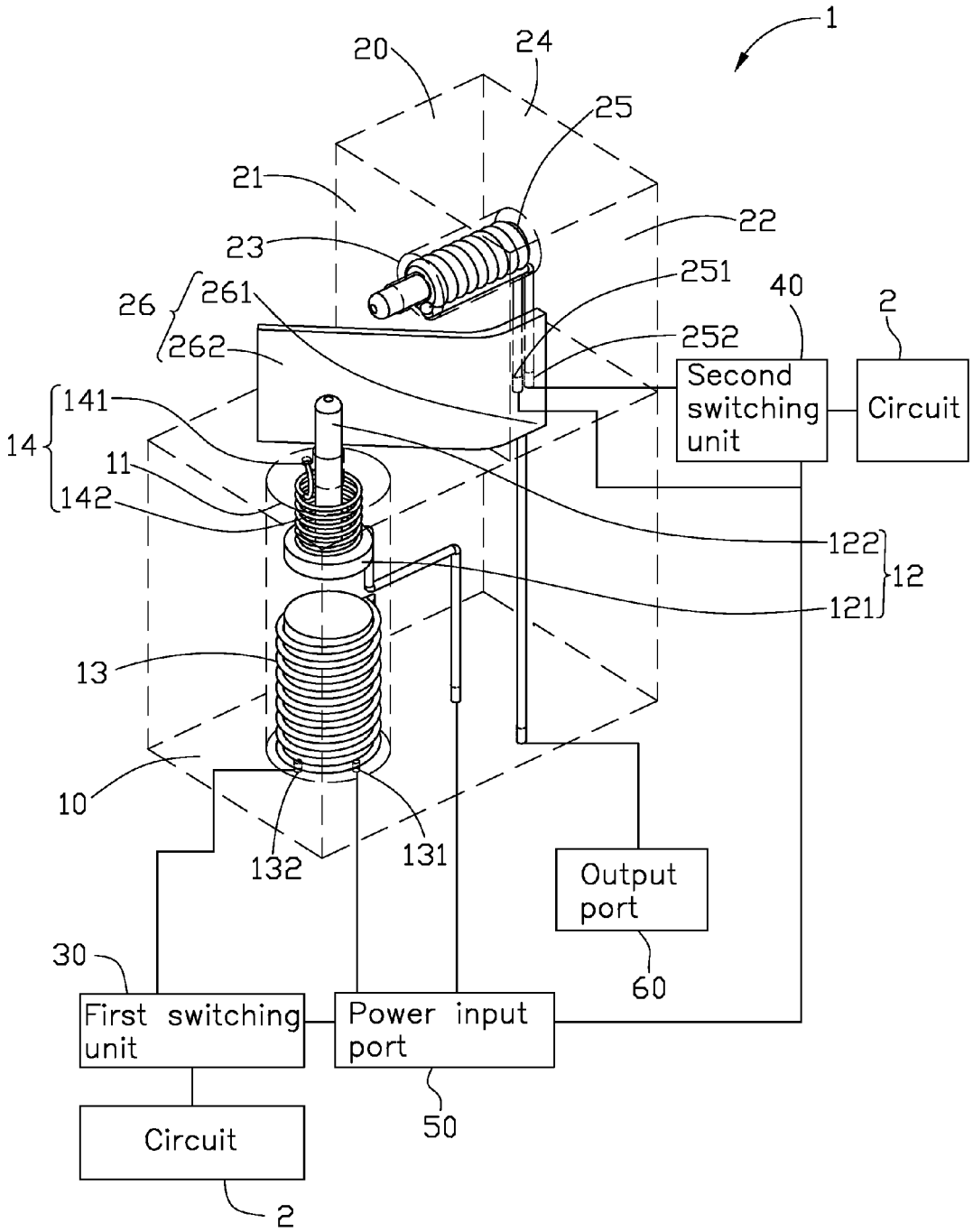
FIG. 1 is a schematic diagram of a relay, in accordance with an exemplary embodiment.
Figure 2:
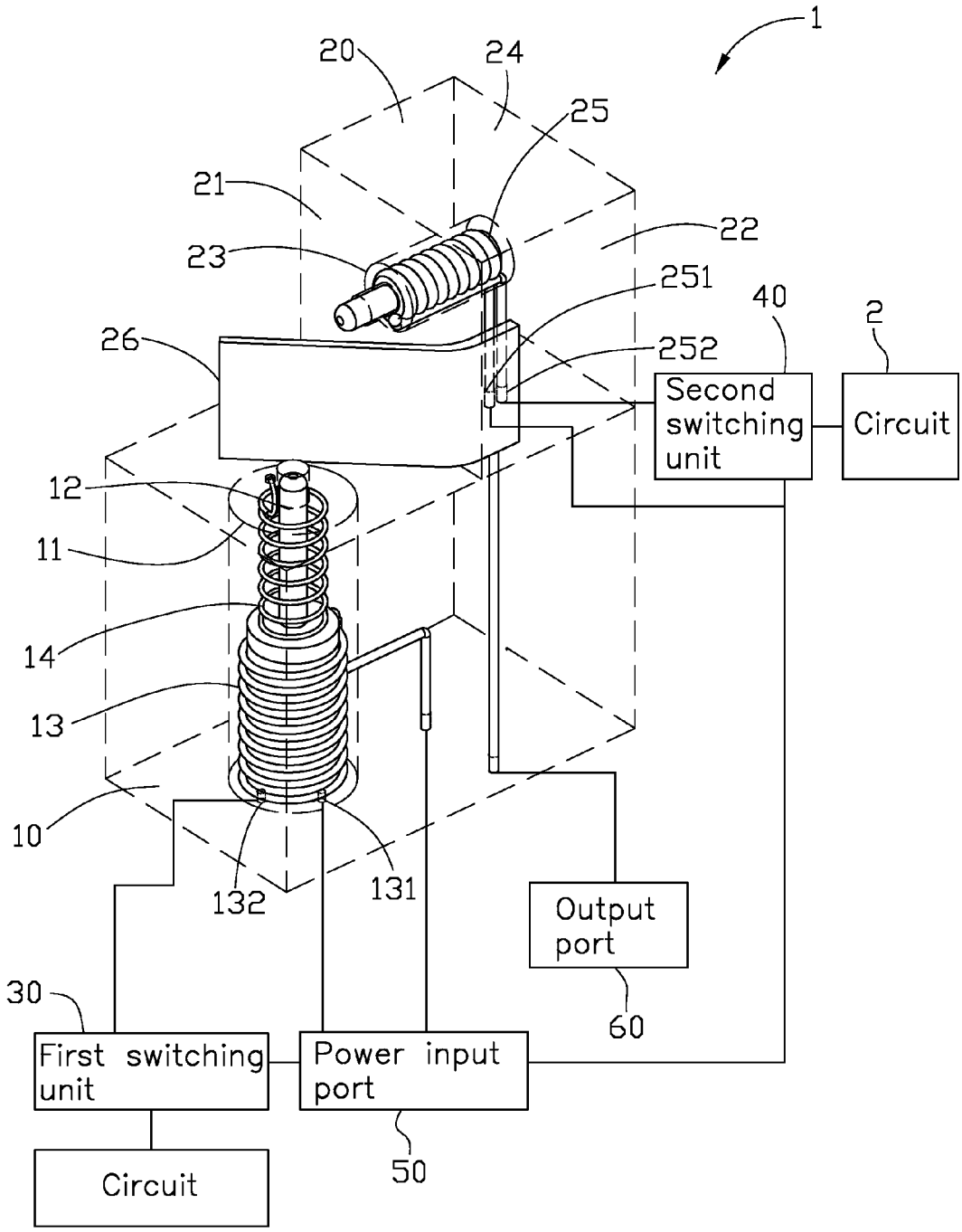
FIG. 2 is a schematic diagram showing a first actuation member of the relay of FIG. 1 under attraction, in accordance with an exemplary embodiment.
Figure 3:
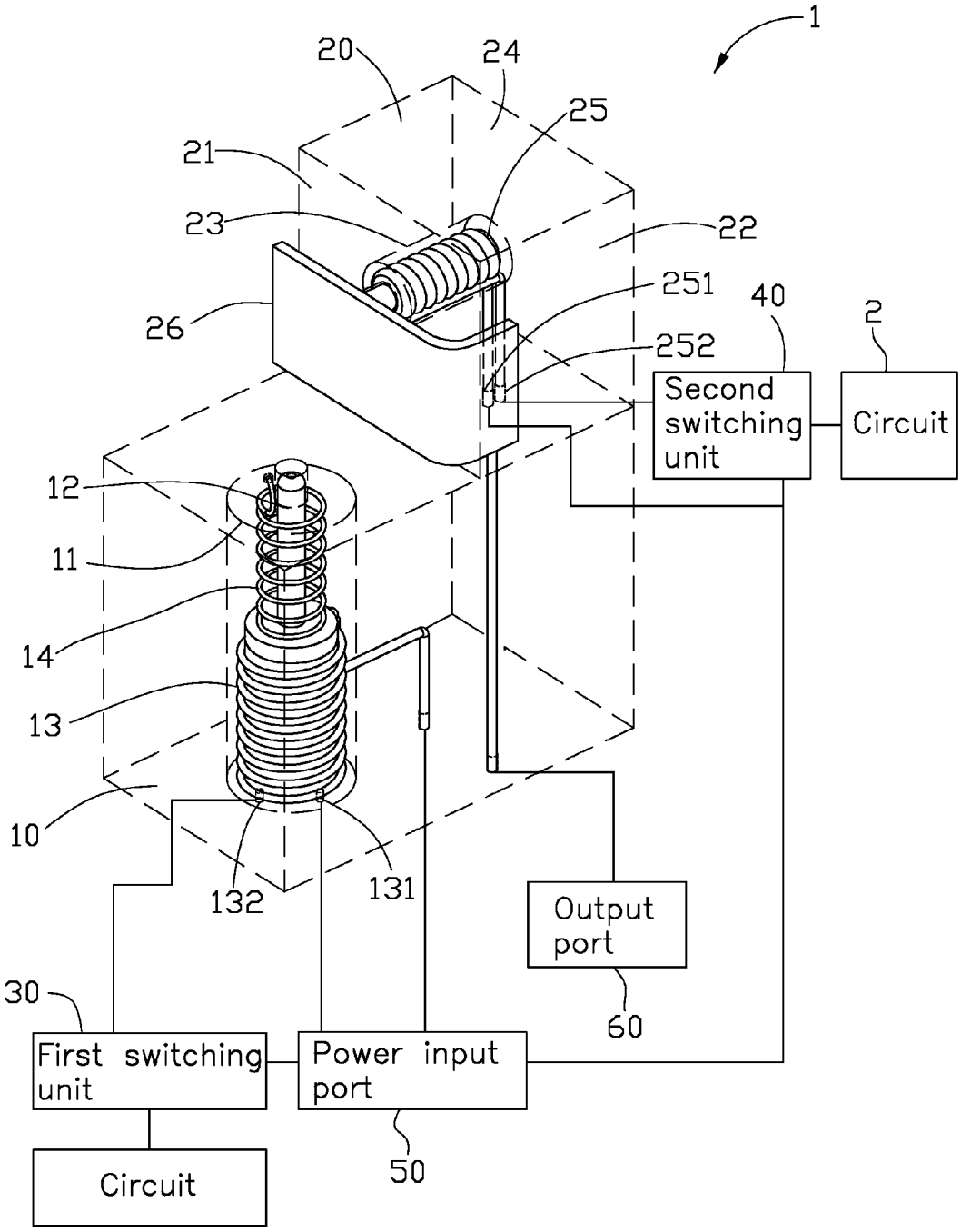
FIG. 3 is a schematic diagram showing a second actuation member of the relay of FIG. 1 under attraction, in accordance with an exemplary embodiment.

Referring to FIGS. 1-3, a relay 1 includes a first shell 10, a first actuation member 12, a first electromagnet 13, a spring member 14, a second shell 20, a second electromagnet 25, a second actuation member 26, a first switching unit 30, a second switching unit 40, a power input port 50, and an output port 60.

The first shell 10 and the second shell 20 both are hollow and cuboid. An upper side of the first shell 10 has a first opening 11, the first electromagnet 13 is fixed on a bottom side of the first shell 10. The first shell 10 is used to fix and hold the spring member 14. A fixed end 141 of the spring member 14 is fixed to the edge of the opening 11, a free end 142 of the spring member 14 is securely attached to a fixed end 121 of the first actuation member 12, a free end 122 of the first actuation member 12 passes through the spring member 14. In the embodiment, the spring member 14 is a coil spring, and the first opening 11, the first actuation member 12 are located right above the first electromagnet 13. Initially, the spring member 14 is uncompressed. The free end 122 of the first actuation member 12 is exposed to the first opening 11 after passing through the spring member 14. Initially, the first actuation member 12 and the first electromagnet 13 are spaced a predetermined distance from each other. The first electromagnet 13 and the second electromagnet 25 both include an iron core and conductive windings wrapping the iron core.

The second shell 20 is an enclosure above the first shell 10. The second shell 20 includes a first side 21, a second side 22, and a third side 24. The first side 21 is aimed out over the top of the first shell 10, the second side 22 is connected to the first side 21, the third side 24 is opposite to the first side 21. The second electromagnet 25 is set inside the second shell 20, and one end of the second electromagnet 25 is fixed on a portion of the third side 24. The first side 21 has a second opening 23, the iron core of the second electromagnet 25 may pass through the second opening 23 and be exposed out of the second opening 23. The second actuation member 26 is outside the second shell 20, in the embodiment, the body of the second actuation member 26 is a curved piece of elastic, namely the second actuation member 26 has an elastic body, a fixed end 261 of the second actuation member 26 is fixed to a portion of the second side 22, and a free end 262 of the second actuation member 26 is bent towards the first side 21.

The first actuation member 12 and the second actuation member 26 may be made of conductive material, such as iron or copper, or simply clad in such conductive material(s) as required. The first actuation member 12 is always electrically connected to the power input port 50, and the second actuation member 26 is electrically connected to the output port 60. In an initial state, the first actuation member 12 is electrically connected to the second actuation member 26 and the power input port 50 is electrically connected to the output port 60 via the first actuation member 12 and the second actuation member 26, the relay 1 is thereby in a closed state, or normally closed.

The power input port 50 receives power from a power source (not shown). The power input port 50 can supply power to the first electromagnet 13 when the first switching unit 30 is turned on, and can supply power to the second electromagnet 25 when the second switching unit 40 is turned on.

To better understand the present disclosure, an example showing a work process of the relay 1 is described below.

Initially, at moment t0, a first control voltage is applied to the first switching unit 30 and the first switching unit 30 is turned on. The first electromagnet 13 receives power from the power input port 50 when the first switching unit 30 is turned on and produces an electromagnetic field to attract the first actuation member 12. The first actuation member 12 overcomes the elasticity of the spring member 14 and pulls away from the second actuation member 26 until it contacts the first electromagnet 13 after a time period t1. Then the electrical connection between the power input port 50 and the output port 60 is broken.

After a time period t0+t1, a second control voltage is applied to the second switching unit 40 and the second switching unit 40 is turned on. The second electromagnet 25 receives power from the power input port 50 when the second switching unit 40 is turned on and produces an electromagnetic field to attract the second actuation member 26. The free end 262 of the second actuation member 26 is attracted towards the second electromagnet 25 and makes contact with the second electromagnet 25 after a time period t2.

After a time period t0+t1+t2, the first control voltage to the first switching unit 30 is stopped and the first switching unit 30 is turned off, accordingly, the first electromagnet 13 stops working, the first actuation member 12 moves away from the first electromagnet 13 due to the elasticity of the spring member 14, and the free end 122 of the first actuation member 12 is exposed out of the first opening 11 after a time period t3.

After a time period t0+t1+t2+t3, the second control voltage to the second switching unit 40 is stopped and the second switching unit 40 is turned off, the second electromagnet 25 stops working, and the second actuation member 26 moves relatively slowly away from the second electromagnet 25, due to the inherent elasticity of the elastic body. The free end 262 of the second actuation member 26 electrically contacts with the first actuation member 12 after a time period t4. Then the electrical connection between the power input port 50 and the output port 60 is established again, and the relay 1 is once again in the closed state.

In the embodiment, the first control voltage and the second control voltage are provided by a circuit 2. Therefore, in the embodiment, the relay 1 is normally closed and will output a voltage when neither the first control voltage nor the second control voltage is being applied to the relay 1. The relay 1 is in the open state and can not output any voltage when either the first control voltage or the second control voltage is applied.

Figure 4:
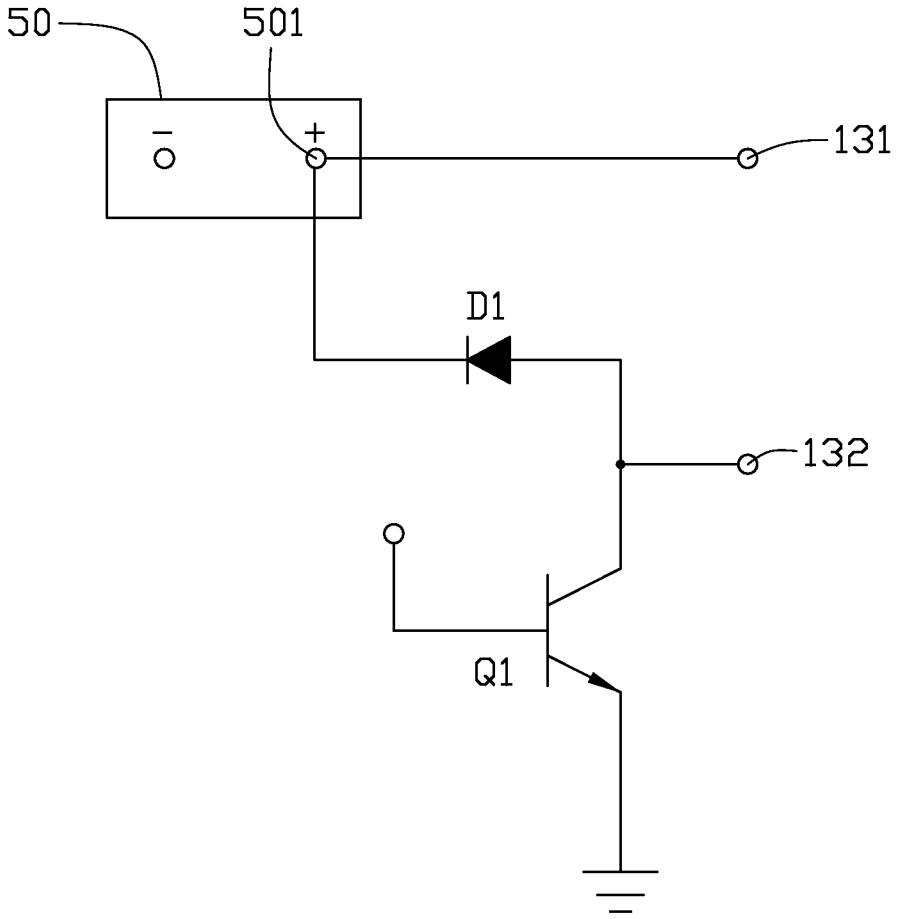
FIG. 4 is a circuit diagram of a first switching unit of the relay of FIG. 1, in accordance with an exemplary embodiment.
Figure 5:
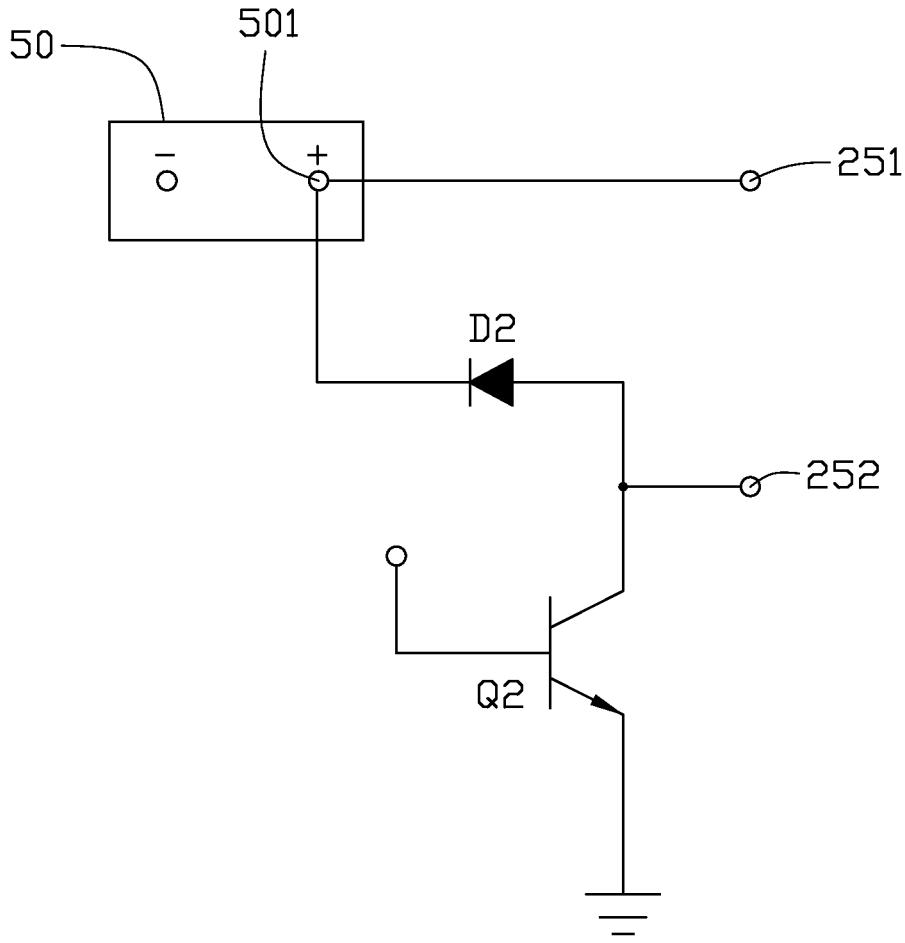
FIG. 5 is a circuit diagram of a second switching unit of the relay of FIG. 1, in accordance with an exemplary embodiment.

Referring to FIGS. 4-5 together, in the embodiment, the first electromagnet 13 includes a first input terminal 131 and a second input terminal 132, and the first input terminal 131 is connected to an anode terminal 501 of the power input port 50. The first switching unit 30 includes a first transistor Q1 and a first diode D1, a base of the first transistor Q1 is used to receive the first control voltage, an emitter of the first transistor Q1 is grounded. A collector of the first transistor Q1 is connected an anode of the first diode D1 and the second input terminal 132, and a cathode of the first diode D1 is also connected to the anode terminal 501 of the power input port 50.

The second electromagnet 25 includes a third input terminal 251 and a fourth input terminal 252, and the third input terminal 251 is connected to the anode terminal 501 of the power input port 50. The second switching unit 40 includes a second transistor Q2 and a second diode D2. A base of the second transistor Q2 is used to receive the second control voltage, a collector of the second transistor Q2 is connected to the fourth input terminal 252 and an anode of the second diode D2, and an emitter of the second transistor Q2 is grounded. A cathode of the second diode D2 is also connected to the anode terminal 501 of the power input port 50.

In the embodiment, the first control voltage and the second control voltage are both around 5 volts. When the first control voltage is applied to the base of the first transistor Q1, the first transistor Q1 is turned on, then the second input terminal 132 is grounded via the first transistor Q1 which is turned on. The power input port 50 allows current to flow from the first input terminal 131 to the second input terminal 132 because the first input terminal 131 is connected to the anode terminal 501 of the power input port 50 and the second input terminal 132 is grounded, and the first electromagnet 13 thus produces the electromagnetic field. Similarly, when the second control voltage is applied to the base of the second transistor Q2, the second transistor Q2 is turned on, the fourth input terminal 252 is grounded via the second transistor Q2 which is turned on, then the power input port 50 allows current to flow from the third input terminal 251 to the fourth input terminal 252, and then the electromagnet 13 produces the electromagnetic field.

Therefore, as described above, in the present disclosure, when neither the first control voltage nor the second control voltage are applied to the relay 1, the relay 1 can function without any power supply for a long time, until a change of state is required, and thus power is saved.

Figure 6:
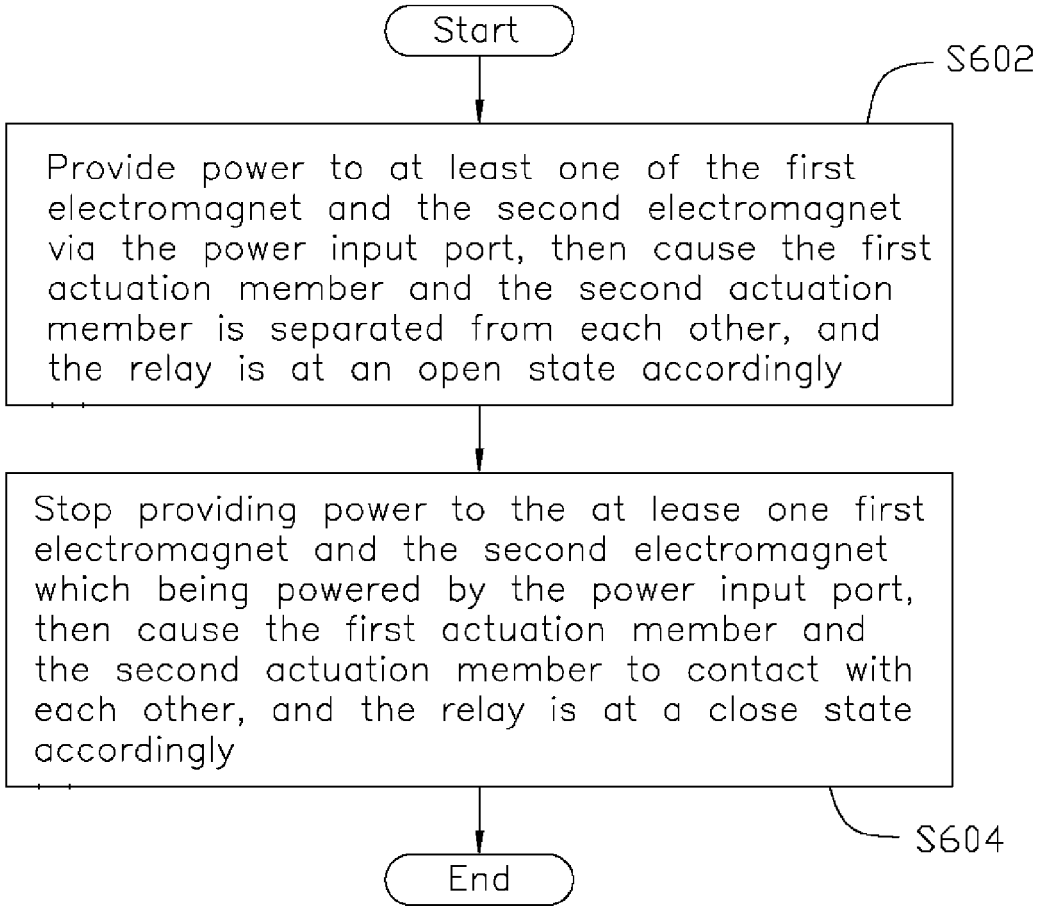
FIG. 6 is a flowchart illustrating a method for controlling a relay, such as that of FIG. 1, in accordance with an exemplary embodiment.

Referring to FIG. 6, a method for controlling the relay of FIG. 1 is illustrated. Initially, the relay 1 is in the closed state and the first actuation member 12 is in contact with the second actuation member 26.

In step S602, the power input port 50 provides power to at least one of the first electromagnet 13 and the second electromagnet 25, then causes the first actuation member 12 and the second actuation member 26 to separate from each other, and the relay 1 is at the open state accordingly. In detail, the power input port 50 provides power to the first electromagnet 13 when the first switching unit 30 is turned on, by the circuit 2 applying a voltage to the first switching unit 30, the first electromagnet 13 then produces an electromagnetic field to attract the first actuation member 12, causing the first actuation member 12 to pull away from the second actuation member 26 until the first actuation member 12 makes contact with the first electromagnet 13. The power input port 50 provides power to the second electromagnet 25 when the second switching unit 40 is turned on by virtue of a second control voltage provided by the circuit 2 to the second switching unit 40, the second electromagnet 25 then produces an electromagnetic field to attract the second actuation member 26 towards itself, the free end 262 of the second actuation member 26 is attracted to move toward to the second electromagnet 25.

In step S604, the power input port 50 stops providing power to the at least one of the first electromagnet 13 and the second electromagnet 25 which being powered by the power input port 50, which causes the first actuation member 12 and the second actuation member 26 to once again make contact with each other, and the relay 1 is then in the closed state. In detail, if the first electromagnet 13 is being powered by the power input port 50, the circuit 2 stops providing power to the first switching unit 30 and turns off the first switching unit 30, then the first electromagnet 13 stops producing an electromagnetic field. The first actuation member 12 moves away from the first electromagnet 13 due to the compression in the spring member 14, the free end 122 of the first actuation member 12 becomes exposed on the first opening 11 and makes contact with the second actuation member 26.

If the second electromagnet 25 is being powered by the power input port 50, then the circuit 2 stops applying the second control voltage to the second switching unit 40 and the second switching unit 40 turns off, removing the supply of power to the second electromagnet 25. Then the second electromagnet 25 stops producing an electromagnetic field, the second actuation member 26 moves away from the second electromagnet 25 over a short period of time due to the inherent elasticity of the elastic body, and the free end 262 of the second actuation member 26 again comes into electrical contact with the first actuation member 12. Then the electrical connection between the power input port 50 and the output port 60 is once again established.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A relay comprising:

a power input port, configured to receive power from a power source;

an output port, configured to output voltage when the relay is at a closed state;

a first actuation member;

a second actuation member;

a first switching unit;

a second switching unit;

a first electromagnet, and a second electromagnet;

wherein, the first actuation member and the second actuation member are separated from each other and the relay is then in an open state when the power input port provides power to at least one of the first electromagnet and the second electromagnet; and the first actuation member and the second actuation member are in contact with each other and the relay is then in a closed state when the power input port stops providing power to the at least one of the first electromagnet and the second electromagnet being powered by the power input port.

2. The relay according to claim 1, wherein, the relay further comprises a first shell, and a spring member comprising two ends, one end is fixed connected to the first shell, and the other end is fixed connected to the first actuation member; the first actuation member and the second actuation member are made of conductive material; initially, when the first actuation member and the second actuation member are in contact with each other, the first switching unit is turned on when being applied a first control voltage thereto, the power input port provides power to the first electromagnet when the first switching unit is turned on, and the first electromagnet produces an electromagnetic field to attract the first actuation member, and causes the first actuation member to overcome the elasticity of the spring member and pull away from the second actuation member until it contacts the first electromagnet, such that the relay is then in the open state; when the first control voltage applied to the first switching unit is stopped, the first switching unit is turned off and the power input port stops providing power to the first electromagnet, the first electromagnet stops producing an electromagnetic field, and the first actuation member moves away from the first electromagnet due to the elasticity of the spring member until the first actuation member is contacted with the second actuation member such that the relay is then in the closed state.

3. The relay according to claim 2, wherein, the second actuation member has an elastic body and the second switching unit is turned on when a second control voltage is applied to it, the power input port provides power to the second electromagnet when the second switching unit is turned on, the second electromagnet produces an electromagnetic field to attract the second actuation member, and the second actuation member undergoes elastic deformation accordingly and separates from the first actuation member such that the relay is then in the open state; the second switching unit is turned off when the second control voltage to it is stopped, then the second electromagnet stops producing electromagnetic field, and the second actuation member moves relatively slowly away from the second electromagnet, due to the inherent elasticity of the elastic body such that the relay is then in the close state.

4. The relay according to claim 3, wherein the relay further comprises a second shell, the first shell and the second shell are both hollow and cuboid, the second shell is an enclosure above the first shell, an upper side of the first shell has an opening, the first electromagnet is fixed on a bottom side of the first shell, a fixed end of the spring member is fixed to the edge of the opening, a free end of the spring member is securely attached to a fixed end of the first actuation member, a free end of the first actuation member passes through the spring member.

5. The relay according to claim 4, wherein the second shell includes a first side, a second side, and a third side, the first side is aimed out over the top of the first shell, the second side is connected to the first side, the third side is opposite to the first side, the second electromagnet is set inside the second shell, and one end of the second electromagnet is fixed on a portion of the third side, the first side has a second opening, the iron core of the second electromagnet is passed through the second opening, the second actuation member is set at the outside of the second shell, a fixed end of the second actuation member is fixed to a portion of the second side, and a free end of the second actuation member is bent toward to the first side.

6. The relay according to claim 2, wherein the first electromagnet comprises a first input terminal and a second input terminal, the first input terminal is connected to an anode terminal of the power input port, the first switching unit comprises a first transistor and a first diode, a base of the first transistor is configured to receive the first control voltage, an emitter of the first transistor is grounded, a collector of the first transistor is connected to an anode of the first diode and the second input terminal, a cathode of the first diode is also connected to the anode terminal of the power input port.

7. The relay according to claim 3, wherein the second electromagnet comprises a third input terminal and a fourth input terminal, the third input terminal is connected to an anode terminal of the power input port, the second switching unit comprises a second transistor and a second diode, a base of the second transistor is configured to receive the second control voltage, a collector of the second transistor is connected to the fourth input terminal and an anode of the second diode, an emitter of the second transistor is grounded, a cathode of the second diode is also connected to the anode terminal of the power input port.

8. A method for controlling a relay, the relay comprising a power input port, a first actuation member, a second actuation member, a first electromagnet, and a second electromagnet, the method comprising:

providing power to at least one of the first electromagnet and the second electromagnet via the power input port, causing the first actuation member and the second actuation member to separate from each other, such that the relay is then in an open state; and stopping providing power to the at least one of the first electromagnet and the second electromagnet being powered by the power input port such that the first actuation member and the second actuation member make contact with each other, such that the relay is then in a closed state.

9. The method according to claim 8, wherein the second actuation member has an elastic body, and the relay further comprises a first switching unit, a second switching unit, a first shell, and a spring member, the first shell is used to fix and hold the spring member, a fixed end of the spring member is fixed to the edge of an opening of an upper side of the first shell, a free end of the spring member is securely attached to a fixed end of the first actuation member; the step of "stopping providing power to the at least one first of the electromagnet and the second electromagnet being powered by the power input port such that the first actuation member and the second actuation member make contact with each other, such that the relay is then in a closed state" comprises:

if the first electromagnet is being powered by the power input port, stopping applying a first control voltage to the first switching unit such that the first switching unit turns off, and the first electromagnet stops producing an electromagnetic field, and the first actuation member moves away from the first electromagnet due to the compression in the spring member; and if the second electromagnet is being powered by the power input port, stopping applying a second control voltage to the second switching unit such that the second switching unit turns off, the second electromagnet stops producing an electromagnetic field, and the second actuation member moves away from the second electromagnet over a short period of time due to the inherent elasticity of the elastic body.

10. The method according to claim 9, wherein the step of "providing power to at least one of the first electromagnet and the second electromagnet via the power input port, causing the first actuation member and the second actuation member to separate from each other, such that the relay is then in an open state" comprises:

applying a second control voltage to the second switching unit and then turning on the second switching unit;

producing power to the second electromagnet via the power input port when the second switching unit is turned on; and producing an electromagnetic field to attract the second actuation member when the second electromagnet receives the power from the power input port due to the second switching unit being turned on such that the second actuation member is attracted to move toward to the second electromagnet.

11. The method according to claim 9, wherein the step of "providing power to at least one of the first electromagnet and the second electromagnet via the power input port, causing the first actuation member and the second actuation member to separate from each other, such that the relay is then in an open state" comprises:

applying a first control voltage to the first switching unit via a circuit and then turning on the first switching unit;

producing power to the first electromagnet via the power input port when the first switching unit is turned on; and producing an electromagnetic field to attract the first actuation member when the first electromagnet receives the power from the power input port such that the first actuation member pulls away from the second actuation member until it makes contact with the first electromagnet.

* * * * *